US005165215A

United States Patent [19]

Menayan

[11] Patent Number: 5,165,215

[45] Date of Patent: Nov. 24, 1992

[54] MACHINE FOR APPLYING TAMPER EVIDENT BANDS TO CONTAINER

[76] Inventor: Victor V. Menayan, 103 Rothschild Pl., Cary, N.C. 27511

[21] Appl. No.: 754,976

[22] Filed: Sep. 4, 1991

[51] Int. Cl.[5] ..... B65B 7/28

[52] U.S. Cl. ..... 53/292; 53/293; 53/313

[58] Field of Search ..... 156/521, DIG. 14, DIG. 15; 53/137.1, 291, 292, 293, 296, 313, 399, 585

[56] References Cited

U.S. PATENT DOCUMENTS

| | | | |
|---|---|---|---|
| 2,751,735 | 6/1956 | Bartlett et al. | 53/292 |
| 3,861,118 | 1/1975 | Muto | 53/292 X |
| 3,888,067 | 6/1975 | Cross et al. | 53/292 |
| 4,293,364 | 10/1981 | Fujio | 53/292 X |
| 4,388,797 | 6/1983 | Shields | 53/292 X |
| 4,497,156 | 2/1985 | Scheidegger | 53/293 X |
| 4,562,688 | 1/1986 | Mueller | 53/399 |
| 4,649,697 | 3/1987 | Konstantin | 53/291 X |
| 4,691,835 | 9/1987 | Mueller | 53/291 X |
| 4,914,893 | 4/1990 | Strub et al. | 53/292 X |
| 5,086,682 | 2/1992 | Strub et al. | 53/297 X |

*Primary Examiner*—Robert L. Spruill
*Assistant Examiner*—Daniel B. Moon
*Attorney, Agent, or Firm*—Rhodes, Coats & Bennett

[57] ABSTRACT

The present invention entails a method and apparatus for applying tamper evident bands to a container. In particular, the apparatus of the present invention directs a supply strip of banding material to a cutter which cuts the supply strip into a series of cut bands. From the cutter, the respective cut bands are, one at a time, transferred to a suction source and held. A form is passed adjacent the suction source and strips the cut band from the suction source. While the cut band is held within the form, a container is passed thereunder, and because of the spacing of the form and the position of the container, the container top or lid engages a portion of the cut band held within the form and strips the cut band from the form. Thereafter, the container and cut form are passed underneath a vibrating plate, causing the plate to engage the cut band and to properly position the same about the container for subsequent heat treatment.

9 Claims, 11 Drawing Sheets

MACHINE FOR APPLYING TAMPER EVIDENT BANDS TO CONTAINER

FIELD OF THE INVENTION

The present invention relates to machines for applying tamper evident bands and more particularly to a method and apparatus where the containers being supplied actually strip a cut band from a form which holds the banding material.

BACKGROUND OF THE INVENTION

Tamper evident bands are used to seal and/or package containers and are extensively used in a wide variety of containment applications. They generally consist of a relatively thin plastic circular band. In some applications, they are placed circumferentially around the interface of a container and its associated lid. When the lid is moved, the band is disrupted, signaling that the container has been tampered with. Most consumer product packages that utilize screw-on or snap-on lids also use tamper evident bands to ensure that consumers receive unopened merchandise. Nearly all drug packages involving screw-on lids use tamper evident bands to ensure that the drugs have not been adulterated after packaging. In other applications, the band may be placed around two or more containers so that they are held together and unitarily packaged. Tamper evident bands are often used to effectively and efficiently package multiple articles even where tampering is not a concern.

Application of tamper evident bands to a container or containers can be accomplished as follows. A tamper evident band supply strip in the form of a rolled, flattened tube is fed to a cutter. The cutter cuts the strip into individual flattened bands. The band is then engaged and held at one point by a point source grasping apparatus, usually a suction pod, such that the band droops downwardly expanding to a generally circular shape. The container or containers are conveyed past the drooping band, and as a result of its placement, they engage and strip the same from the suction pod. Once the band has been stripped, the band and container pass beneath a slanted plate guide which forces the band down onto the container so that it properly circumscribes the container. The container or containers with the band are subsequently heat treated to shrink and secure the band.

While the basic steps of the method just described are theoretically cost effective and efficient in applying tamper evident bands, these steps have several significant drawbacks in practice.

One problem is the inability to adequately control the position of the band. The size of the band and the size of the container are usually very close and, in order for the application to be effective, they must be properly held and oriented relative to each other. The band itself is light-weight, flexible and, because it usually originates from a flattened and rolled state, tends to assume an irregular shape. Very often a point source grasping apparatus such as a suction pod or cup allows the band to droop in a position that is out of proper alignment with the oncoming container. Moreover, static electricity inherent in the band inhibits the band from expanding properly. If the band and container are not properly oriented, the application fails. This problem is even more pronounced when the container and band are larger and therefore harder to control. There exists a need for an improved cost-effective and efficient means for positively orienting the band with respect to the path of the container.

Another problem inherent in the use of a point source for engaging the band is the tendency for the suction pod to inadequately grasp the band. The band must somehow be pushed up against the suction pod to aid in the grasping process. The nature of the plastic band further compounds the problem. The surface of the band does not always conform to the surface of the pod. This can present a problem because the band must be positively attached to the vacuum pod. Because the band is formed of thin plastic and originates as a flattened roll, it tends to have a relatively large amount of static electricity. In particular, the static electricity tends to cause segments of the band to "cling" together and resist opening. Therefore, there exists a need for an improved grasping system which positively directs the band against the suction pod and which neutralizes the static electricity associated with the band such that the band will open and droop relatively long.

As previously mentioned, tamper evident band application machines generally utilize a plate guide to ultimately position the band onto the container. The plate guide is usually stationary. Some attempts have been made to positively press down the band with the plate guide, being moved up and down by a spring loaded plate. Because the ultimate position of the band on the container is both aesthetically and functionally important, there exists a need for an improved plate guide which will efficiently and cost-effectively position the band on the container.

SUMMARY AND OBJECTS OF THE INVENTION

The present invention is an improved apparatus for applying tamper evident bands to a container which efficiently and cost-effectively reduces or eliminates the above described problems inherent in prior tamper evident band application machines. To enhance control of the band position, the present invention uses an independent, hollow form for receiving the band from the point source suction pod and for continuously retaining the band about the interior area of the form and in proper alignment until it is stripped away by a passing container. To aid in engagement of the band with the suction pod, the present invention utilizes a timely ionized air blast from a nozzle positioned opposite the suction pod which serves to push the cut band towards the suction pod while simultaneously neutralizing the static electricity inherent in the band. In order to more effectively position the band on a container, the present invention uses a plate guide equipped with a vibrator mechanism to aid the band in sliding into position on the container.

It is therefore an object of the present invention to provide an improved tamper evident band application machine which is capable of effectively and efficiently applying tamper evident bands to containers.

Another object of the present invention resides in the provision of a tamper evident band application machine having a form that enhances control of band position and thereby facilitates the accurate placement of the band on a container.

Another object of the present invention resides in the provision of a timely ionized air blast to facilitate the engagement of the band with a point or limited area suction source.

Another object of the present invention resides in the provision of a vibrator equipped plate guide to positively urge the band into accurate placement on a container.

It is an object of the present invention to provide an improved tamper evident band application apparatus that has the capability to handle relatively large bands and particularly to hold and position these bands to be stripped by containers themselves.

A further object of the present invention resides in the provision of a holding mechanism that encompasses the band and thereby shapes and holds it at a multiplicity of points rather than holding it at a single point as in conventional methods.

A further object of the present invention resides in the provision of a tamper evident band application apparatus of the character referred to above that utilizes a suction pod transfer device in conjunction with the aforementioned form-type holding mechanism.

It is a further object of the present invention to provide a tamper evident band application machine with means for electrically neutralizing the cut band such that the static electricity associated with the band material will not adversely effect the subsequent handling of the band.

It is an object of the present invention to provide tamper evident band application machine that is provided with a cut band transfer and application sub-system that is effective to transfer the cut band from the cutting sub-system to the container with more positive control over the band from the cutting sub-system to the container.

It is an object of the present invention to provide a transfer application sub-system which is capable of precisely aligning and orienting the cut band in a stationary holder such that the cut band can be stripped from the holder by a passing container.

Other objects and advantages of the present invention will become apparent and obvious from a study of the following description and the accompanying drawings which are merely illustrative of such invention.

DETAILED DESCRIPTION OF THE INVENTION

Figure 1:
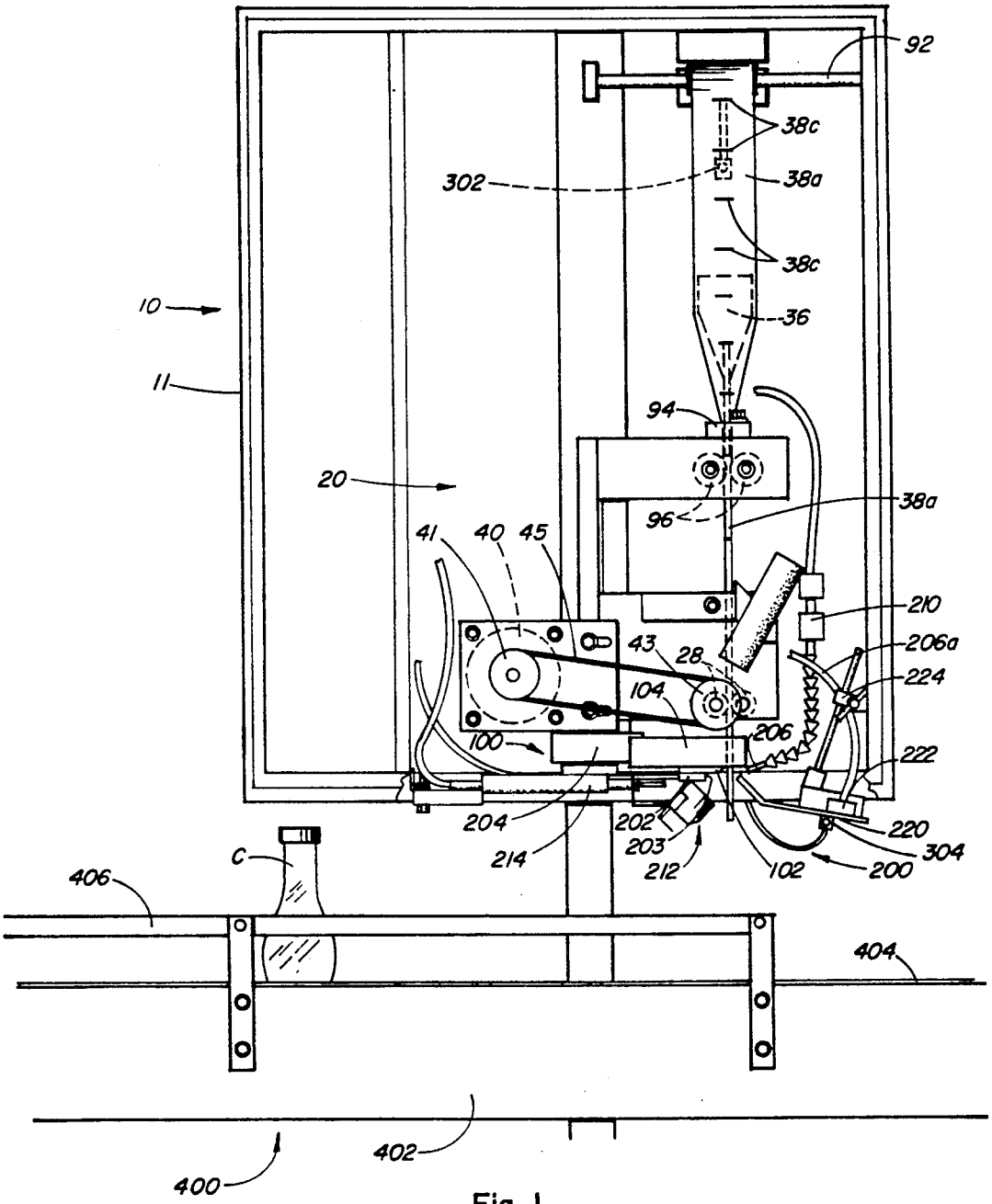
FIG. 1 is a side elevational view of the tamper evident band application machine of the present invention with a side panel removed to better illustrate the structure of the same.

The present invention relates to an improved machine for applying tamper evident bands to containers. Machines for applying tamper evident bands are well-known in the prior art and are used throughout the world for applying tamper evident bands to a wide variety of containers. For examples of typical machines for applying tamper evident bands, one is referred to the disclosures found in U.S. Pat. Nos. 4,914,893; 2,623,673; 2,751,735; and 3,802,152, these disclosures being expressly incorporated herein by reference. Therefore, in describing the machine of the present invention for applying tamper evident bands, it will be appreciated that much of the structure and function of the machine is conventional. For that reason, a detailed description of the entire machine will not be dealt with herein in detail.

With further reference to the drawings, the machine for applying tamper evident bands is indicated generally by the numeral 10. Forming a part of the machine 10 is a housing structure 11 that generally encloses the basic working parts of the machine. Machine 10 of the present invention comprises four basic sub-systems, a feed sub-system 20, a cutting sub-system 100, a transfer and application sub-system 200, a control sub-system 300. Briefly viewing each of the sub-systems before proceeding with a detailed description of the invention, it should be pointed out that the feed sub-system 20 functions to direct and advance an elongated strip of band material **38*a* to the cutting sub-system 100. Cutting sub-system 100 cuts the supply strip 38*a* into individual cut bands 38*b* that are ultimately applied to containers. Once cut, each cut band 38*b* is engaged by the transfer and application sub-system 200. Transfer and application sub-system 200 functions to grasp the cut band 38*b* and to position the same for an efficient transfer onto a passing container. All of the aforementioned sub-systems are integrally controlled by a conventional control sub-system 300**. A more detailed description of each sub-system follows.

Figure 2:
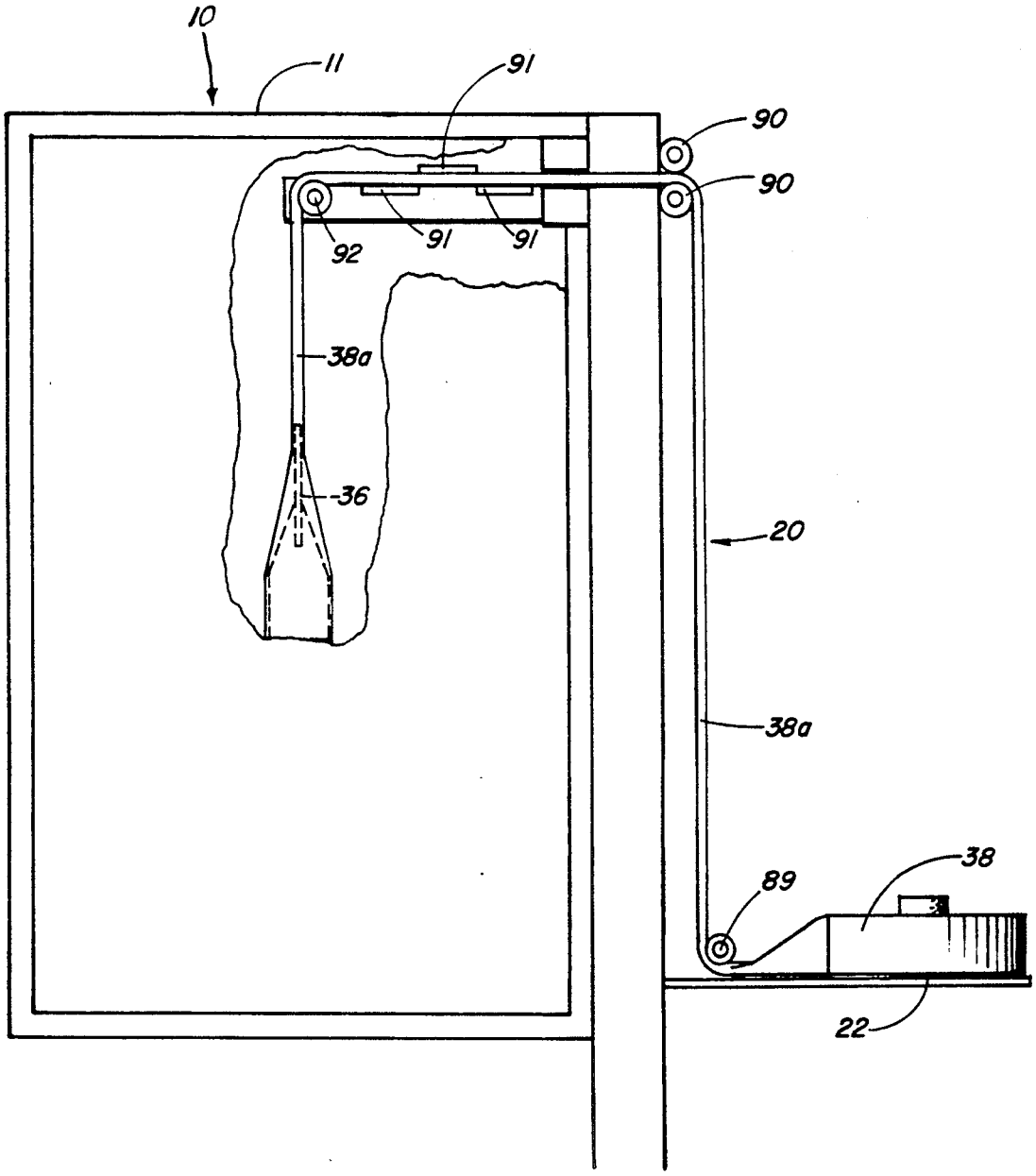
FIG. 2 is a back elevational view of the tamper evident band application machine of the present invention with a portion removed to better illustrate the threading of the supply strip into the machine.

Now with respect to the feed sub-system 20 and FIGS. 1 and 2, it is seen that the housing 11 is provided with an exterior spindle plate 22 which supports a band supply roll 38. A supply strip **38*a* is pulled from the band supply roll 38 and trained around a lower idler 89 (FIG. 2) and extended upwardly to were the supply strip 38*a* is threaded between two turn rollers 90. From turn rollers 90, the supply strip 38*a* is fed through a series of plates 91 and then around another turn idler 92. Once supply strip 38***a* has been turned around to idler 92, the same is directed through two pairs of idlers 94 and 96. Idlers 94 and 96 are paired such that the upper two idlers 94 are turned at an angle of 90° with respect to the lower two idlers 96. Lower idlers 96 tend to form a pair of creases about opposite flat sides of supply strip 38*a*. It is appreciated that due to the nature of the band supply 38 that the supply strip 38*a* would include natural creases about opposed vertical sides of the strip as viewed in FIG. 1.

Disposed below the lower idler rollers 96 is a pair of feed or drive rollers 28. Supply strip 38*a* is threaded through feed rollers 28 and is gripped therebetween. Feed rollers 28 are driven by a motor 40 that includes an output drive sheave 41 that drives a driven sheave 43 through belt 45. Driven sheave 43 is coupled directly to one of the feed rollers 28 and acts to drive the same. Feed rollers 28 includes a meshed gear arrangement (not shown) that results in the driven roller actually driving the other roller in counterrotating fashion.

As seen in FIG. 1, the supply strip 38*a* is threaded with a device that is referred to us as a bullet 36. Bullet 36 is disposed with the supply strip 38*a* just above the upper idler rollers 94. Bullets are typically used in feeding sub-systems of conventional machines for applying tamper evident bands. As suggested in FIG. 1, bullet 36 rest just above the upper rollers 94, and in fact is confined within the supply strip 38*a* by the rollers 94. Bullet 36 tends to condition the supply strip 38 such that the supply strip has a tendency, after passing around the bullet 36, to assume an open tubular shape for configuration. This, as will be appreciated from subsequent portions of this disclosure is important from the standpoint of preparing the banding material for application to containers.

Cutting sub-system 100 is disposed below feed rollers 28 and functions to cut the supply strip 38*a* being fed downwardly thereto into a series of cut bands 38*b*. That is, motor 40 through a step controller progressively advances supply strip 38*a* downwardly into the cutting sub-system 100 which continues in a repeating fashion to cut bands 38*b* from the supply strip 38*a*.

Figure 3:
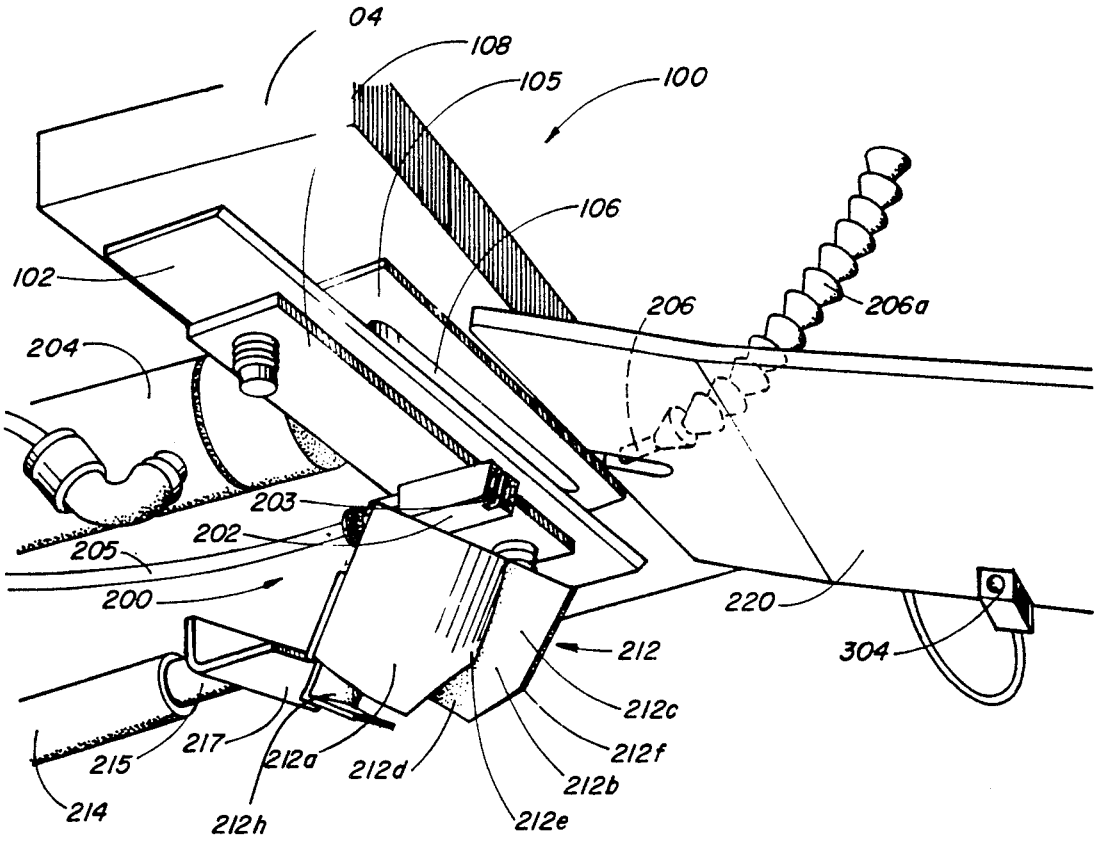
FIG. 3 is a fragmentary perspective view showing the cut band transfer and application sub-system of the present invention.

With reference to FIG. 3 and the cutting sub-system 100, it is seen that the same includes a cutting block 104 that includes a lower wear plate 105. An elongated slit 106 is formed in the cutting block 104 and wear plate 105 and extends downwardly therethrough for permitting the supply strip 38*a* to pass therethrough. A cutting blade 102 is mounted below and closely adjacent wear plate 105. Blade 102 is moveable back and forth across slit 106 for the purpose of cutting the supply strip 38*a* into bands 38*b*. A carrier plate 108 is secured to the underside of blade 102 while blade 102 is connected and driven by a double acting air cylinder 204. Thus, through the control system, to be discussed subsequently herein, the double acting air cylinder 204 is controlled causing blade 102 to be moved back and forth across slit 106.

Disposed below the cutting sub-system 100 is the transfer and application sub-system 200. Transfer and application sub-system 200 functions to grasp the cut band 38*b* and to hold the same and to effectuate transfer of the cut band 38*b* onto an underlying passing container C that is disposed on a conveyer system that passes adjacent the tamper evident band application machine 10.

Reviewing transfer and application sub-system 200 in more detail, the same includes a suction pod 202 that is secured to carrier plate 108 and is carried back and forth by blade 102. Thus, it is appreciated that suction pod 202 moves back and forth with blade 102 and is effectively controlled by the actuating of double acting air cylinder 204. As illustrated in FIG. 3, suction pod 202 is formed at a complex angle. Suction pod 202 includes a front face 203 that is angled downwardly. Also note that face 203 of suction pod 202 is V-shaped and includes a pair of suction openings, with a suction opening being formed in each side of the V-shaped face 203. In the preferred embodiment, the downward angle of the front face 203 is approximately 30° while the V-shaped angle of the face is approximately 15°. It is appreciated, however, that these angles can change depending on objectives and application. Extending from the rear of suction pod 202 is a suction line 205 that is connected to a vacuum source (not shown).

Figure 15:
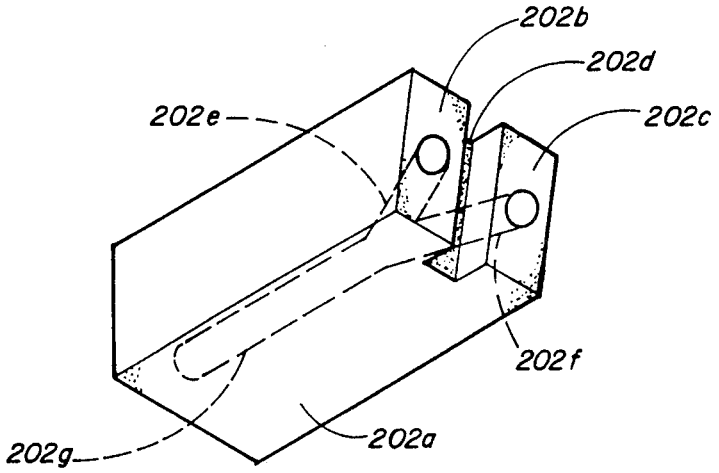
FIG. 15 is a perspective view of an alternate design for the suction pod of the present invention.
Figure 16:
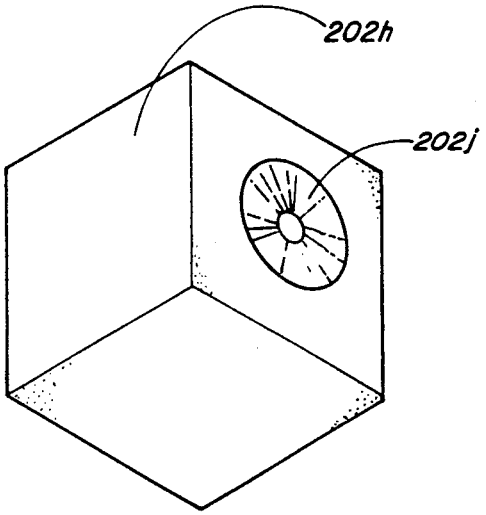
FIG. 16 is a perspective view of a second alternate design for the suction pod of the present invention.
Figure 17:
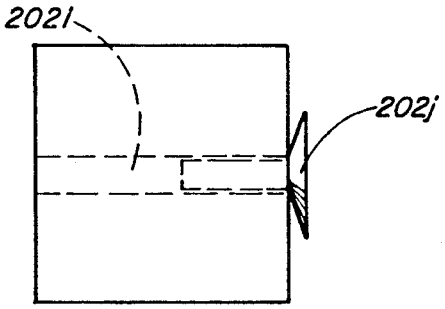
FIG. 17 is a side elevational view of the suction pod shown in FIG. 16.

In FIGS. 15–17, there is shown two alternate designs for the suction pods. FIG. 15 depicts a suction pod 202*a* that includes a pair of faces 202*b* and 202*c* separated by an elongated vertical slot 202*d*. Each suction face 202*b* and 202*c* includes a suction opening that is connected to split manifolds 202*e* and 202*f*. The respective manifolds 202*e* and 202*f* join a central manifold 202*g* that is connected to a vacuum source. The provision of the elongated slot 202*d* permits a seam area of the cut band 38*c* to be received therein.

Turning to the alternate suction pod design shown in FIGS. 16 and 17, it is seen that the suction pod 202*h* includes a suction line opening 202*i*. Pressed fitted into line 202*i* is a rubber suction tip 202*j* that projects from the front of the suction pod 202*h*. It is appreciated that suction tab 202*j* is effectively sealed within the pod 202*h* such that there is little or no leakage between line 202*i* and the exterior of the suction tab insert 202*j*.

Positioned opposite suction pod 202 and fixedly mounted adjacent thereto is an air nozzle 206. Air nozzle 206 is connected to an air pump (not shown) through a connecting hose 206*a*. Prior to exiting air nozzle 206, air passing from the air pump to the nozzle passes through an electrical ionizer 210 which effectively removes the static from the cut band 38*b* being blasted by the air nozzle 206. It is appreciated that nozzle 206 is directed downwardly towards the face 203 of the suction pod 202. In effect, the air blast from nozzle 206 is directed against the cut band 38*b* that has just been cut or is in the process of being cut so as to urge the cut band 38*b* against face 203 of the suction pod 202. Thus, it is appreciated that the air blast dispersed from nozzle 206 increases the effectiveness of the transfer of the cut band from the cutting sub-system 100 to the suction pod 202. It should be appreciated that a plurality of air nozzles 206 could be used.

Disposed below the suction pod 202 is a band receiving form 212 that is designed to receive a cut band 38*b* from the suction pod. As illustrated in the drawings, form 212 is comprised of a generally C-shaped wall structure having an interior wall 212*b*, exterior wall 212*a*, and terminal edges 212*e* and 212*f*. Terminal edges 212*e* and 212*f* form a side opening 212*c*. Formed internally within the C-shaped wall structure is a central opening 212*d*. Central opening 212*d* and side open area 212*c* are shaped and sized so as to receive the particular cut band to be applied. As illustrated in the drawings, form 212 is disposed at an elevation with respect to the suction pod 202 where the form 212 essentially has to pass through the plane of the suction pod 202. In order to accommodate this design feature, the form 212 is provided with a slot 212g that is formed in the upper rear side wall structure. This permits form 212 to be moved back and forth with respect to the suction pods 202 and actually permits the suction pod 202 to pass through the C-shaped wall structure of the form 212.

Form 212 includes a lower ledge 212h. As seen in the drawings, ledge 212h depends downwardly from the backside of form 212 and is of a general L-shape. The lower portion of the ledge 212h includes a flat plat or frame that serves to support and hold a portion of the cut band 38b.

Form 212 is secured to an L-shaped bracket 217 that is in turn secured to a rod 215 that projects from a spring loaded single-acting air cylinder 214. Air cylinder 214 is maintained in a normal retracted position by a spring (not shown) associated with the cylinder 214 while the cylinder is extended by air directed into the same.

As illustrated in the drawings, disposed adjacent form 212 is a vibrating guide plate 220. Plate 220 is adjustably mounted by adjustable mounting assembly 224 that permits the plate structure to be moved up and down with respect to the underlying conveying system. Secured to plate 220 is a pneumatic vibrator 222 that imparts a relatively high frequency vibration to the plate structure 220. This vibrating action assists the plate in effectively positioning a cut band 38b around the top of a container C passing underneath the tamper evident band application machine 10. As will be understood from subsequent portions of the disclosure, after a tamper evident band 38b has been applied to the top or neck of a container C, the band 38b and container pass under plate 220 and the plate is so spaced such that it generally engages the cut band 38b disposed atop of the container C and assists in properly positioning the cut band 38b about the container as the container C passes underneath plate 220.

Forming a part of the overall control sub-system 300 is a photoelectric cell 304 that is secured to or adjacent vibrating plate 220.

Photo-cell 304 effectively senses the presence of a passing container C and in turn, controls (through the control sub-system 300) the movement of form 212 and blade 102 which in turn controls the movement of suction pod 202.

Disposed below the machine 10 is a conveyor system indicated generally by the numeral 400. Conveyor system 400 includes a frame structure 402 that has associated therewith a moving conveyor belt 404 that is designed to move container C (See FIG. 1) from left to right underneath the cut band application machine 10. Also as indicated in FIG. 1, the conveyor 400 is provided with a side rail structure 406 for confining the containers C on the conveyor.

Figure 14:
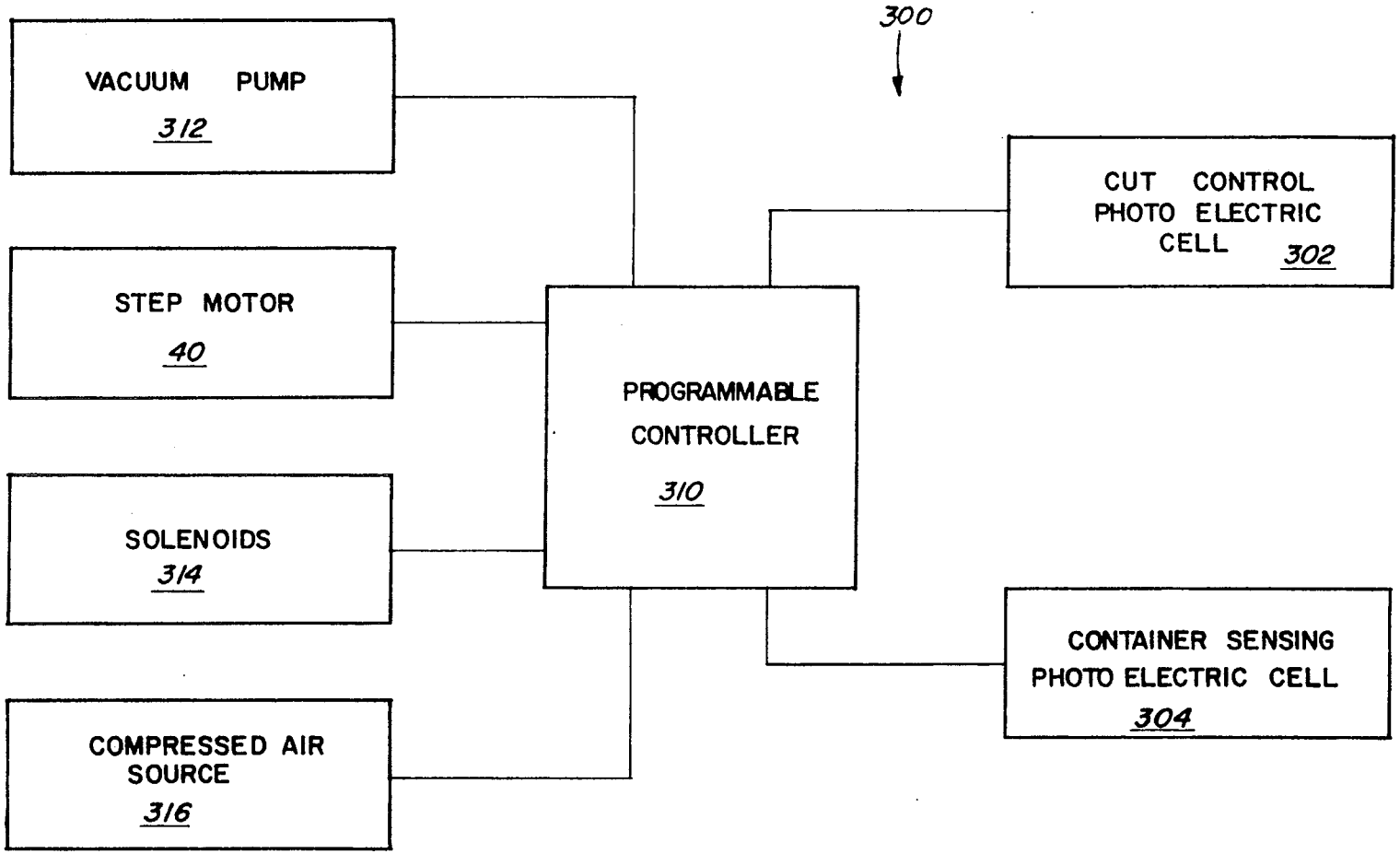
FIG. 14 is a block diagram showing the control sub-system for the cut band application machine of the present invention.

Referring now to FIG. 14, control sub-system 300 of the present invention is shown therein in block diagram form. It should be pointed out that control sub-system 300 is of the same nature and characteristics as control sub-system 300 conventionally used in tamper evident band application machines. For this reason, a detailed discussion of control sub-system 300 will not be taken up here. However, for a more complete and unified understanding of the present invention, the control sub-system 300 will be briefly described.

Referring to FIG. 14, it is seen that the central element of control sub-system 300 is programmable controller 310 which is adapted to receive input from cut control photoelectric cell 302 and container sensing photoelectric cell 304. Programmable controller 310 controls the operation of vacuum pump 312, step motor 40 solenoids 314, and air pump 316.

As shown in FIG. 1, supply strip 38a includes a series of spaced indicia marks 38c. Photoelectric cell 302 located adjacent supply strip 38a senses these indicia marks 38c and directs that information to programmable controller 310. As discussed later, programmable controller 310 responds by stopping step motor 40. This permits control sub-system 300 to control the height of respective cut bands 38b cut by cutting sub-system 100. Programmable controller 310 further responds to the input from photoelectric cell 302 by initiating an operation sequence which is discussed in greater detail hereinafter. In this sequence, programmable controller 310 controls the actuation of vacuum pump 312, air pump 316, and the actuation of double acting air cylinders 204 and 214 through solenoids 314. In this way, programmable controller 310 controls the suction at suction pod 202, the air blast from air nozzle 206 and the fore and aft motion of suction pod 202, blade 102, and form 212. Photoelectric cell 304 secured to vibrating plate 220 senses the passing of containers C and directs this information to programmable controller 310. Programmable controller 310 responds to this input by running step motor 40 and sensing all other operations.

Figure 18:
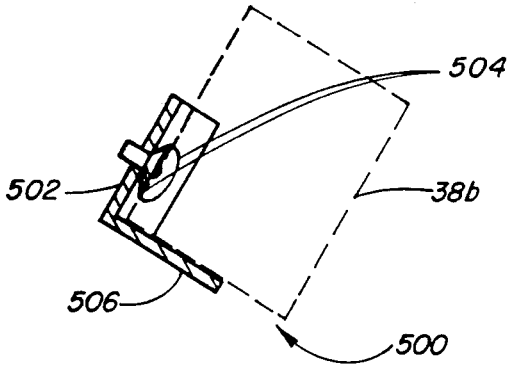
FIG. 18 is a side elevational view of a suction pod and integral ledge assembly used for receiving and holding a cut tamper evident band.
Figure 19:
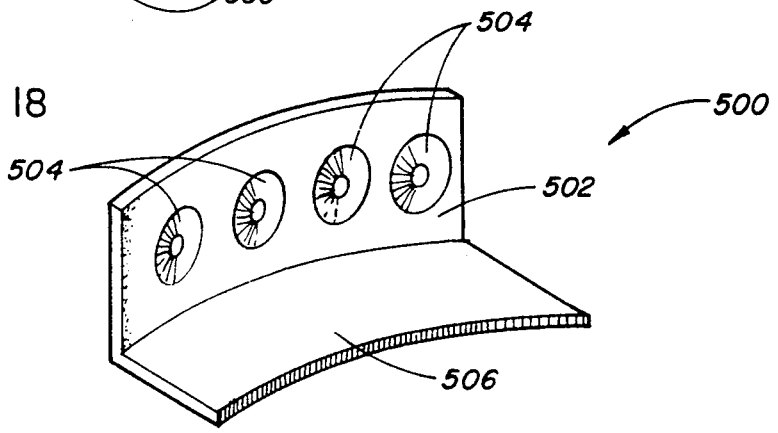
FIG. 19 is a perspective view of the suction pod and integral ledge assembly shown in FIG. 18.
Figure 20:
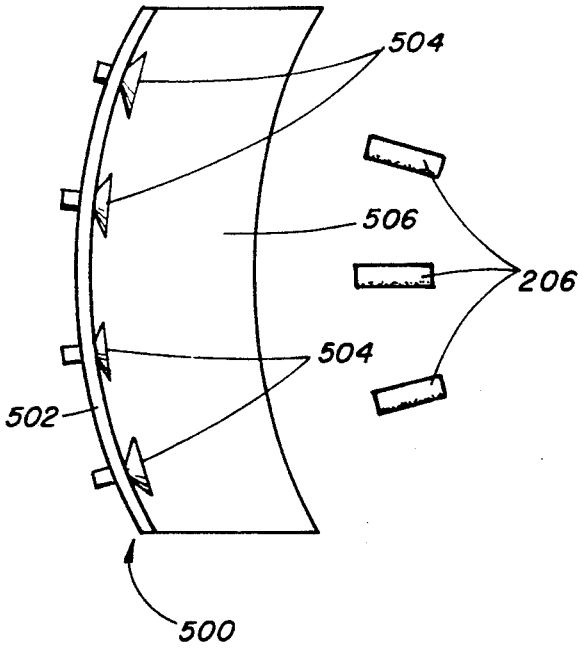
FIG. 20 is a top plan view of the suction pod and ledge assembly shown in FIGS. 18 and 19.

Turning to FIGS. 18–20, an alternate design is shown for transferring the cut band 38b from the cutting apparatus onto a container C. In this case, there is provided a suction pod assembly with an integral ledge or shelf support, indicated generally by the numeral 500. By providing an integral ledge to the suction pod assembly, the need for a form 212 is obviated. Thus, the suction pod and integral wedge assembly 500 shown in FIGS. 18–20 serves to grasp the cut bands 38b and to retain and position the same for direct application to an underlying passing container C.

Viewing suction pod and integral ledge assembly 500 in more detail, it is seen that the same includes a slightly curved back plate 502 that includes a plurality of suction points in the form of suction cups 504 formed in the back plate 502. Secured to the lower portion of the back plate 502 and angled downwardly therefrom, as shown in FIG. 18, is an integral ledge plate or shelf support 506. The ledge plate 506 is particularly angled downwardly such that the right hand portion of the cut band 38b, as viewed in FIG. 18, droops downwardly so as to occupy a position in the path of a passing container C. It is appreciated that as the passing container C moves underneath ledge 506, the top of the container will engage the lower drooping portion of the cut band 38b and pull the same off ledge 506 as well as stripping the band 38b from the suction points or cups 504. It will be appreciated that the suction pod and integral ledge 500 can be moved back and forth and up and down by conventional fluid cylinder means. In the case of the suction pod and integral ledge assembly 500, it is desirable to provide a plurality of air jets 206 to assist in positively transferring the cut band 38b from the cutting assembly to the suction cups 504. This is especially true since the suction pod assembly 500 is designed to handle relatively large diameter bands. For example, the suction pod assembly and integral ledge 500, shown in FIGS. 18–20, is particularly designed to handle tamper bands having a circumference of 400 mm or more. It is appreciated that the suction pod and integral ledge design 500 shown in FIGS. 18–20 could in fact accommodate and efficiency handle tamper evident bands that are smaller in diameter than 400 ml.

Figure 21:
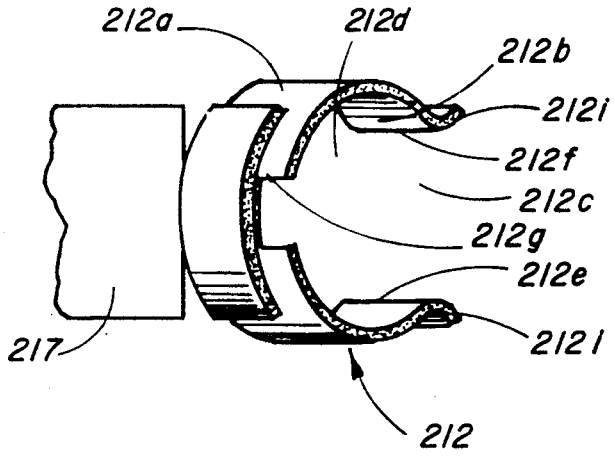
FIG. 21 is a perspective view of an alternate design for the form of the present invention.

Turning to FIG. 21, an alternative design is shown for the form 212. The embodiment of FIG. 21 is essentially the same as that already shown and described with the exception of the provision of a pair of outwardly tapered wall portions 212*i* that projects forwardly from the mouth of the form 212. These tapered wall portions, which are sometimes referred to as "lead-ins", served to facilitate the transfer of the cut band 38*b* from the suction pod into the form 212 itself.

Operation of the tamper evident band application machine is controlled by the programmable controller 310. The machine operates in cycles which begin with the feeding of the supply strip 38*a* and end with a complete engagement of a cut band 38*b* with a container C. A description of a single cycle follows. Such cycles may be executed over sixty times per minute, providing for quick and efficient tamper evident band application. Values hereinafter stated will vary with particular applications and depend on the size of the containers, properties of the tamper evident bands, and related parameters.

Figure 7:
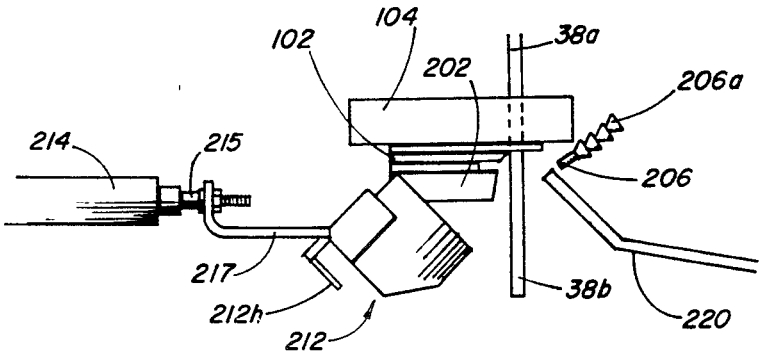
FIGS. 7–13 are a series of schematic sequence views illustrating the transfer of a cut band from the cutting sub-system to a passing container.

At the beginning of a cycle, step motor 40 is running and as a result supply strip 38*a* is pulled downwardly through slot 106 by feed rollers 28. At this time, the air and vacuum pumps are not actuated and blade 102 and suction pod 202 are fully retracted. (See FIG. 7) This continues until cut control photo-cell 302 senses the next succeeding indicia strip 38*c* on supply strip 38*a*. At this time, the end of supply strip 38*a* protruding through slot 106 is equal to the desired band width.

Figure 8:
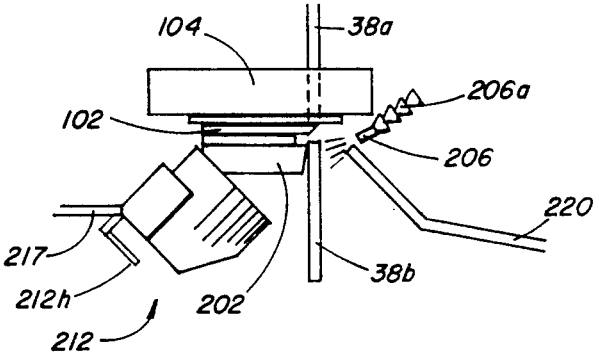
Figure 9:
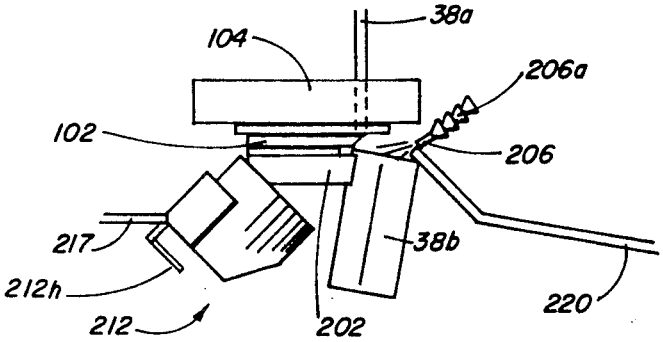

When cut control photo-cell 302 registers the next succeeding indicia 38*c*, the programmable controller 310 signals the actuation of the vacuum pump 312 and cylinder 204 so that blade 102 and suction pod 202 extend towards slot 106 and a vacuum is generated at suction pod 202. As blade 102 fully extends, it cuts a band 38*b* and suction pod 202 simultaneously engages and holds this band by suction (FIG. 8). To aide suction pod 202 in making contact with cut band 38*b*, an air blast of approximately 0.2 to 1.0 second is directed against cut band 38*b* forcing it against suction pod 202 (FIG. 9). Because the air blast is ionized, it tends to neutralize the static electricity that is inherent in cut band 38*b* allowing the same to more readily expand to a generally circular shape and eliminating the repellence between cut band 38*b* and suction pod 202. Because front face 203 of suction pod 202 is V-shaped, it more easily engages cut band 38*b* by receiving a crease of the same in the apex of the V-shaped face.

Figure 4:
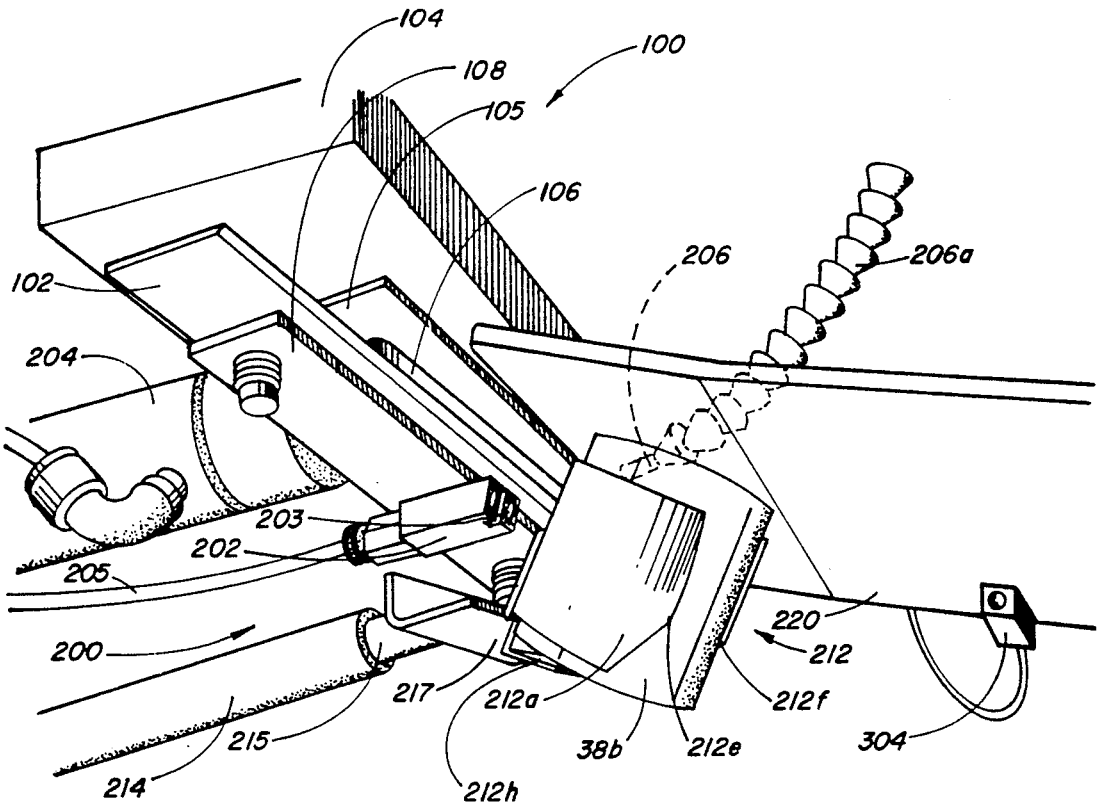
FIG. 4 is a fragmentary perspective view showing the transfer and application sub-system of the present invention wherein the form engages.
Figure 5:
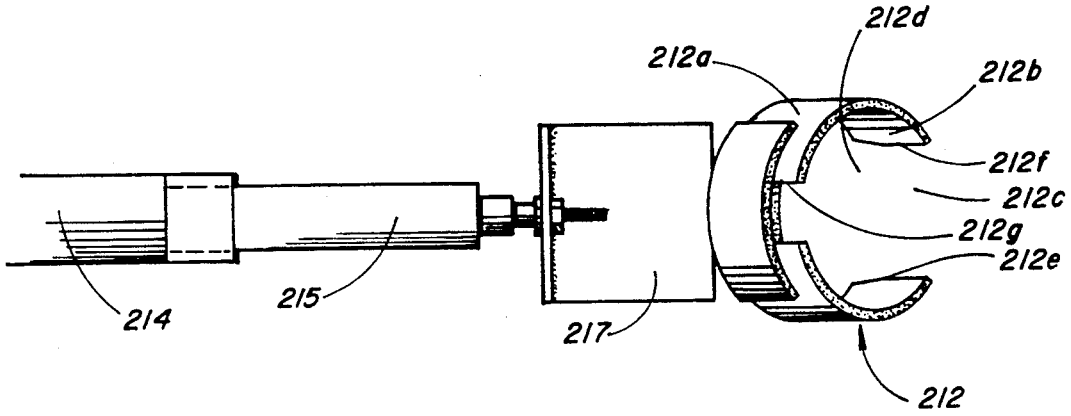
FIG. 5 is a top plan view of the form which forms a part of the transfer application sub-system of the present invention.
Figure 6:
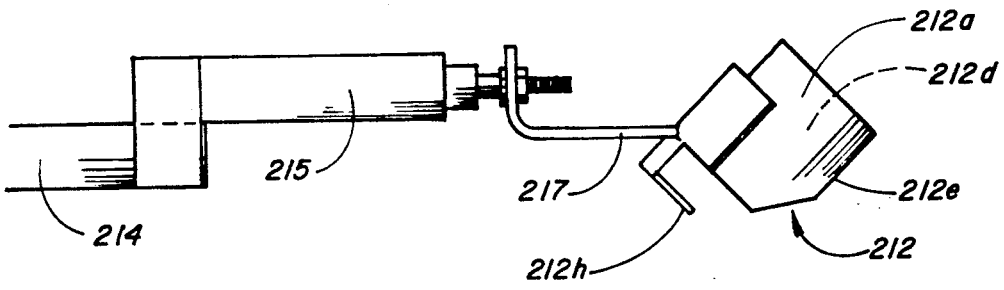
FIG. 6 is a side elevational view of the form which forms a part of the transfer and application sub-system of the present invention.
Figure 10:
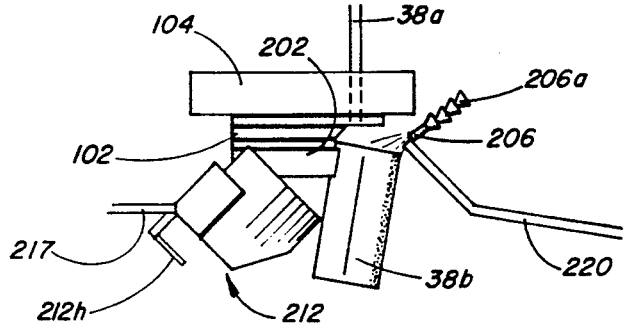
Figure 11:
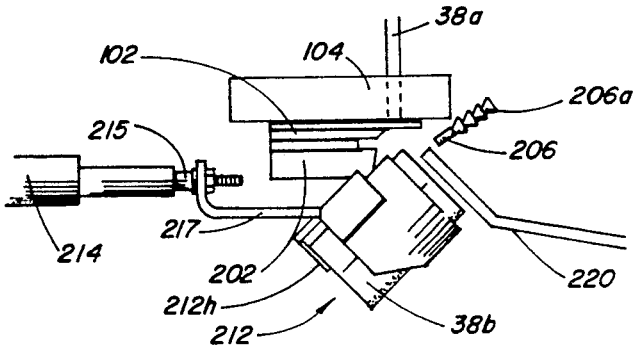
Figure 12:
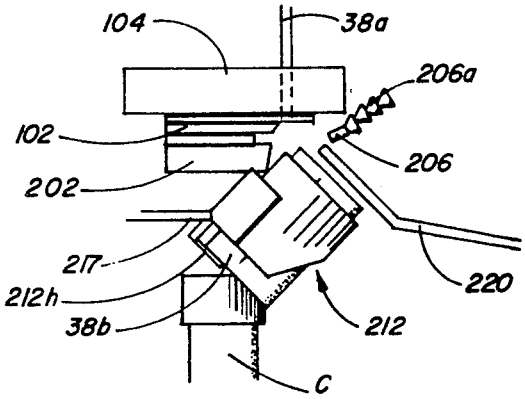
Figure 13:
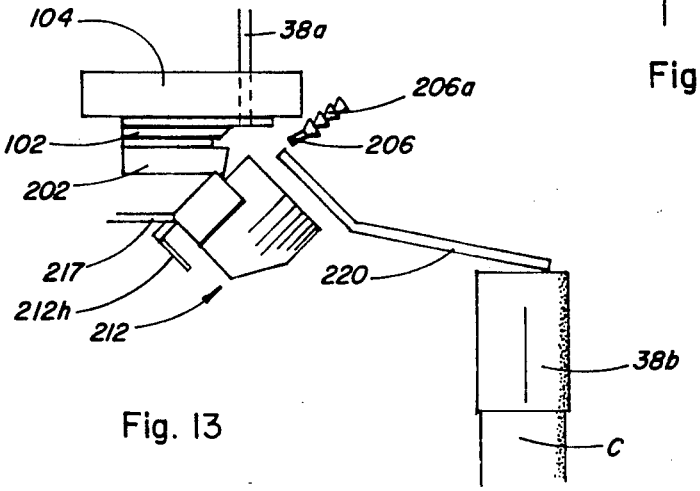

Once cut band 38*b* is engaged and held by suction pod 202, suction pod 202 and blade 102 retract fully (FIG. 10). After a short delay (approximately 0.5 to 1.3 ms) to allow cut band 38*b* to expand, cylinder 214 is actuated and the rod 215 thereof extended so that form 212 moves forward. As form 212 moves forward, it receives cut band 38*b* through side open area 212*c*. As noted earlier, front face 203 of suction pod 202 is angled downward so that it holds cut band 38*b* at a downward angle. Form 212 is angled at approximately the same angle and thereby engages cut band 38*b* squarely within central opening 212*d*. Once encompassed by form 212, cut band 38*b* is held by substantial and continuous contact with interior wall 212*b*. As form 212 continues to extend forward, cut band 38*b* is stripped from suction pod 202 (FIG. 11). After form 212 with cut band 38*b* has been extended fully, a passing container C engages cut band 38*b* and strips it from form 212 (FIGS. 12 and 13). Because the cut band 38*b* is held at a downwardly sloping angle (FIGS. 4, 11, and 12) the container C first engages the inner wall of cut band 38*b* so that a portion of cut band 38*b* surrounds the container C. Form 212 remains extended until container sensing photo-cell 304 senses a passing container C which generally corresponds with the stripping of cut band 38*b*. Once photo-cell 304 has detected the passing container C, then air cylinder 214 is allowed to retract and the next cycle begins.

After container C strips cut band 38*d* from form 212, it passes beneath sloped plate guide 220. Plate guide 220 gradually forces cut band 38*b* down onto the container until it is in an appropriate position. Vibrator 222 causes cut band 38*b* to be efficiently and accurately positioned upon the container C for subsequent heat treatment.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. In a tamper evident band application machine, a device for applying tamper evident bands to containers conveyed past the tamper evident band application machine, comprising:

(a) cutting means for cutting a tamper evident band from a supply strip; and (b) means for transferring cut tamper evident bands from the cutting means to passing containers, said means including:

(1) side gripping and holding means for engaging a side portion of a cut band and holding the same;

(2) cooperative bottom edge support means for engaging and supporting a bottom edge of the cut band such that the side gripping and holding means and bottom edge support means cooperate to hold and support the cut band about both a side portion and a bottom edge of the band; and (3) means for assisting the positioning and transfer of the held cut band from the side gripping and holding means and bottom edge support means to a passing container.

2. The invention of claim 1 wherein the side gripping and holding means and bottom edge support means are integral.

3. The invention of claim 2 wherein the side gripping and holding means includes at least one suction cup and wherein the bottom edge support means is disposed below the suction cup and projects forwardly therepast.

4. The invention of claim 1 wherein the side gripping and holding means includes at least one suction cup and wherein the bottom edge support means is disposed below the suction cup and projects forwardly past the suction cup, such that the suction cup engages a side of the cut band while the lower edge of the cut band is supported by the bottom edge support means.

5. The invention of claim 4 wherein the machine includes air blast means selectively directed to impinged against a tamper evident band that has been cut from the supply strip to urge that band into contact with the transfer means.

6. The invention of claim 5 wherein the machine is provided with means for ionizing air directed at the band for effectively eliminating static electricity associated with the band.

7. The invention of claim 1 including means for directing an air blast against the tamper evident band so as to urge the tamper evident band against the transfer means such that the air blast tends to facilitate the engagement of the tamper evident band with the transfer means.

8. The invention of claim 7 including means for ionizing the air expelled by the air blast means such that the ionized air tends to neutralize the static associated with the cut bands.

9. The invention of claim 1 wherein the means for assisting the positioning and transfer of the held cut band includes vibrating means for vibrating a cut band once the cut band has been placed on a container.

* * * * *